US007314051B2

(12) United States Patent
Yuhara et al.

(10) Patent No.: US 7,314,051 B2
(45) Date of Patent: Jan. 1, 2008

(54) AIRTIGHT COMPACT CONTAINER

(75) Inventors: Yukitomo Yuhara, Chiba (JP); Takayuki Tokushita, Tokyo (JP)

(73) Assignee: Yoshida Industry Co., Ltd., Tokyo (JP)

( * ) Notice: Subject to any disclaimer, the term of this patent is extended or adjusted under 35 U.S.C. 154(b) by 97 days.

(21) Appl. No.: 11/460,661

(22) Filed: Jul. 28, 2006

(65) Prior Publication Data

US 2007/0029226 A1 Feb. 8, 2007

(30) Foreign Application Priority Data

Aug. 5, 2005 (JP) ..... 2005-228911

(51) Int. Cl.
*A45D 33/24* (2006.01)

(52) U.S. Cl. ..... 132/294; 132/300; 206/581

(58) Field of Classification Search ..... 206/235, 206/581, 823; 132/293, 294, 300, 314, 315, 132/317

See application file for complete search history.

(56) References Cited

U.S. PATENT DOCUMENTS 5,353,818 A * 10/1994 Suzuki et al. ..... 132/300
5,950,639 A * 9/1999 Suzuki et al. ..... 132/294
6,076,679 A * 6/2000 Yuhara et al. ..... 206/581
6,129,089 A * 10/2000 Yuhara ..... 132/300
6,138,686 A * 10/2000 Yuhara ..... 132/294
6,311,701 B1 * 11/2001 Yuhara et al. ..... 132/294
6,386,209 B1 * 5/2002 Yuhara et al. ..... 132/294

FOREIGN PATENT DOCUMENTS

| | | |
|---|---|---|
| JP | 2000-139556 | 5/2000 |
| JP | 2000-217628 | 8/2000 |
| JP | 2000-217630 | 8/2000 |

* cited by examiner

*Primary Examiner*—Luan K. Bui
(74) *Attorney, Agent, or Firm*—Harness, Dickey & Pierce, PLC

(57) ABSTRACT

A refill container housing-type airtight compact container comprises a container body 2; a lid body 3; a refill container 7; an inner frame 4 that has a circumference wall 29 and an annular cover 18 formed around the circumference wall to conceal a container joint 15 and a cut 14 and to cover a space between the circumference wall and the container body, that is fixed in the container body to house the refill container therein, and that has formed therein an engaging tab that fastens the refill container, a hinge receiving portion 35, and a recess 37 that receives a closing portion 36 of the refill container; a finger-hooking flange 27 of a lid portion 5 of the refill container; a press-down portion 28 of the lid body that presses down the finger-hooking flange; first and second airtight seal portions 58, 59 that seal the refill container air-tightly; and a push piece 8 that opens the lid body and the lid portion at the same time.

6 Claims, 5 Drawing Sheets

AIRTIGHT COMPACT CONTAINER

CROSS-REFERENCE TO RELATED APPLICATIONS

The present application claims priority from Japanese Patent Application No. 2005-228911 filed on Aug. 5, 2005, which is herein incorporated by reference.

TECHNICAL FIELD

The present invention relates to a new refill container housing-type airtight compact container that can simplify the structures of the container body and of the refill container with use of a separate inner frame and achieve, with this inner frame, comprehensive improvement such as improvement in the capability of housing the refill container, improvement in open/close operability of the refill container and the container body, diversity in the structure of a push piece, and improvement in the capability of air-tightly sealing.

BACKGROUND ART

Of this kind of compact containers, particularly compact containers with a refill container having airtightness, there are known an airtight cosmetic container that makes a makeup operation easy to do by making the lid of the refill container that is being opened move outside the container body of the compact container (Japanese Patent Application Laid-Open Publication No. 2000-139556) and a cosmetic container that, once its push piece is operated, lets the lid body of the compact container open and simultaneously releases airtightness inside the refill container that has been held at negative pressure so as to be at atmospheric pressure, thereby making the lid of the refill container easy to open thereafter (Japanese Patent Application Laid-Open Publication Nos. 2000-217628 and 2000-217630).

The above conventional compact containers are solutions to respective individual problems that are intended to improve makeup operability and operability in opening respectively, and thus, there is the problem that the structure of the container body or of the refill container is complex.

DISCLOSURE OF THE INVENTION

The present invention was made in view of the above problem with the conventional containers, and an object of the invention is to provide a refill container housing-type airtight compact container that can simplify the structures of the container body and of the refill container with use of a separate inner frame and achieve, with this inner frame, comprehensive improvement such as improvement in the capability of housing the refill container, improvement in open/close operability of the refill container and the container body, diversity In the structure of a push piece, and improvement in the capability of air-tightly sealing.

An airtight compact container according to the present invention comprises a container body having a cavity formed on its top side and a cut in its circumference wall; a lid body coupled to the container body via a joint so as to be able to open/close; an annular inner frame attached in the cavity of the container body; a refill container that is detachably attached inside the inner frame; and a push piece attached in the cut of the container body so as to be operable to be pushed in. The inner frame has a circumference wall that, when attached, is located away inwards from the inside wall of the container body and an annular cover extending from the top of the circumference wall to the inside wall of the container body. The refill container has a plate to contain a cosmetic; a lid portion rotatably coupled to the plate via a hinge to open and close the plate; a closing portion to openably fasten the lid portion to the plate; and a finger-hooking flange extending laterally outwards from the top of the closing portion. The plate of the refill container is provided with an annular groove defined and formed by a pair of annular walls facing each other, and an annular recess is formed above the annular groove alone its circumferential direction such that a corresponding space width differs from that of the annular groove; the lid portion has formed on its bottom a flexible, downward piece to be inserted into the annular groove when the lid portion is closed to the plate, and the downward piece has a first airtight sealing portion that elastically contacts and presses against one of the annular walls, thereby air-tightly sealing the lid portion to the plate and a second airtight sealing portion that elastically contacts and presses against the other of the annular walls, thereby air-tightly sealing the lid portion to the plate. The circumference wall of the inner frame has on its inside an engaging means that detachably engages with the outside wall of the plate of the refill container, and the annular cover of the inner frame has recesses that receive respectively the hinge and the closing portion of the refill container; the outer end of the finger-hooking flange of the refill container is formed so as to engage with a press-down portion formed in the inside of a circumference wall of the lid body when the lid body is closed to the container body, thereby being pressed down. The push piece has a push wall to be pushed in; a top wall extending from the top of the push wall through between the circumference wall and annular cover of the inner frame inwards of the container body; a hook that detachably engages with the lid body thereby maintaining the container body closed; a pushing-up portion formed at the inward end of the top wall so as to contact the lower edge of the lid portion of the refill container, which portion exerts an upward divided force on the lower edge of the lid portion when the push wall and thus the top wall are pushed in; and a restoring means that elastically restores the push piece pushed in.

Preferably, a radial width at the annular recess between the annular walls of the refill container is larger than that of the annular groove, and the lower part of the downward piece is thinner radially than the upper part thereof and smaller in radial width than the annular groove. When the lid portion is closed to the plate, the outward surface of the lower end of the extending downward piece is elastically pressed against the outer one of the annular walls while the inward surface of the upper end of the extending downward piece is elastically pressed against the inner one of the annular walls.

More preferably, the lid portion of the refill container is formed larger in diameter than the plate, and when the push piece is pushed in, the pushing-up portion acts to push up the periphery of the lid portion at the lower edge.

More preferably, the hook of the push piece is formed protruding upwards from the top wall.

More preferably, the pushing-up portion of the push piece has formed thereon a downward slope that slopes down in a pushing-in direction.

Alternatively, the pushing-up portion of the push piece is formed substantially in a triangle shape in side sectional view, where its lower surface is an upward slope that slopes up in a pushing-in direction, while its upper surface is a downward slope that slopes down in the pushing-in direction, and part of the top wall connected with the pushing-up portion is formed as a flexible portion that enables the pushing-up portion to swing up and down; the upward slope contacts the lid portion of the refill container, and the downward slope slides along a guide slope provided at the back of the cut of the container body when being pushed in.

The airtight compact container according to the present invention can simplify the structures of the container body and of the refill container with use of a separate inner frame and achieve, with this inner frame, comprehensive improvement such as improvement in the capability of housing the refill container, improvement in open/close operability of the refill container and the container body, diversity in the structure of a push piece, and improvement in the capability of air-tightly sealing.

BEST MODE FOR CARRYING OUT THE INVENTION

Figure 1:
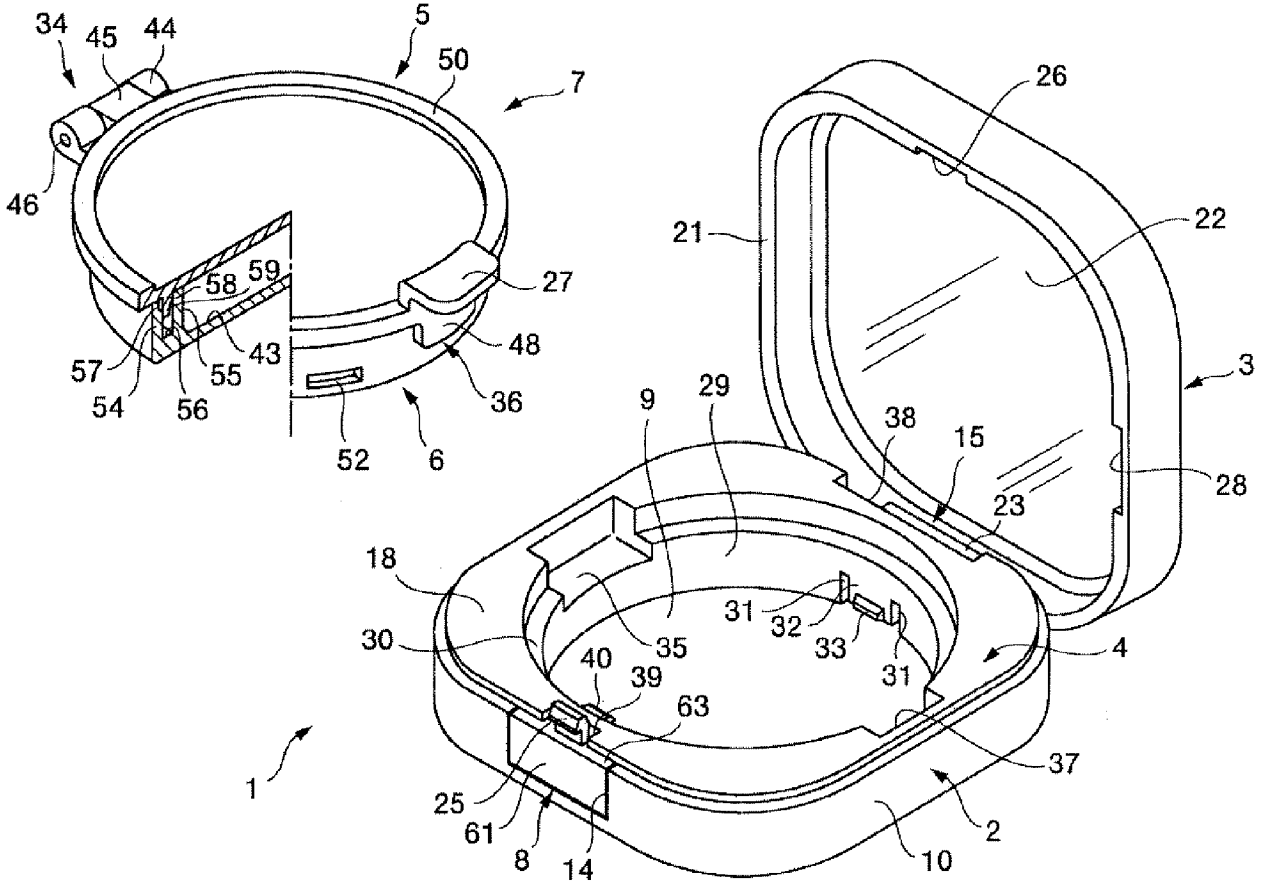
FIG. 1 is a partially cut-away perspective view illustrating the entire configuration of a preferred embodiment of an airtight compact container according to the present invention.
Figure 2:
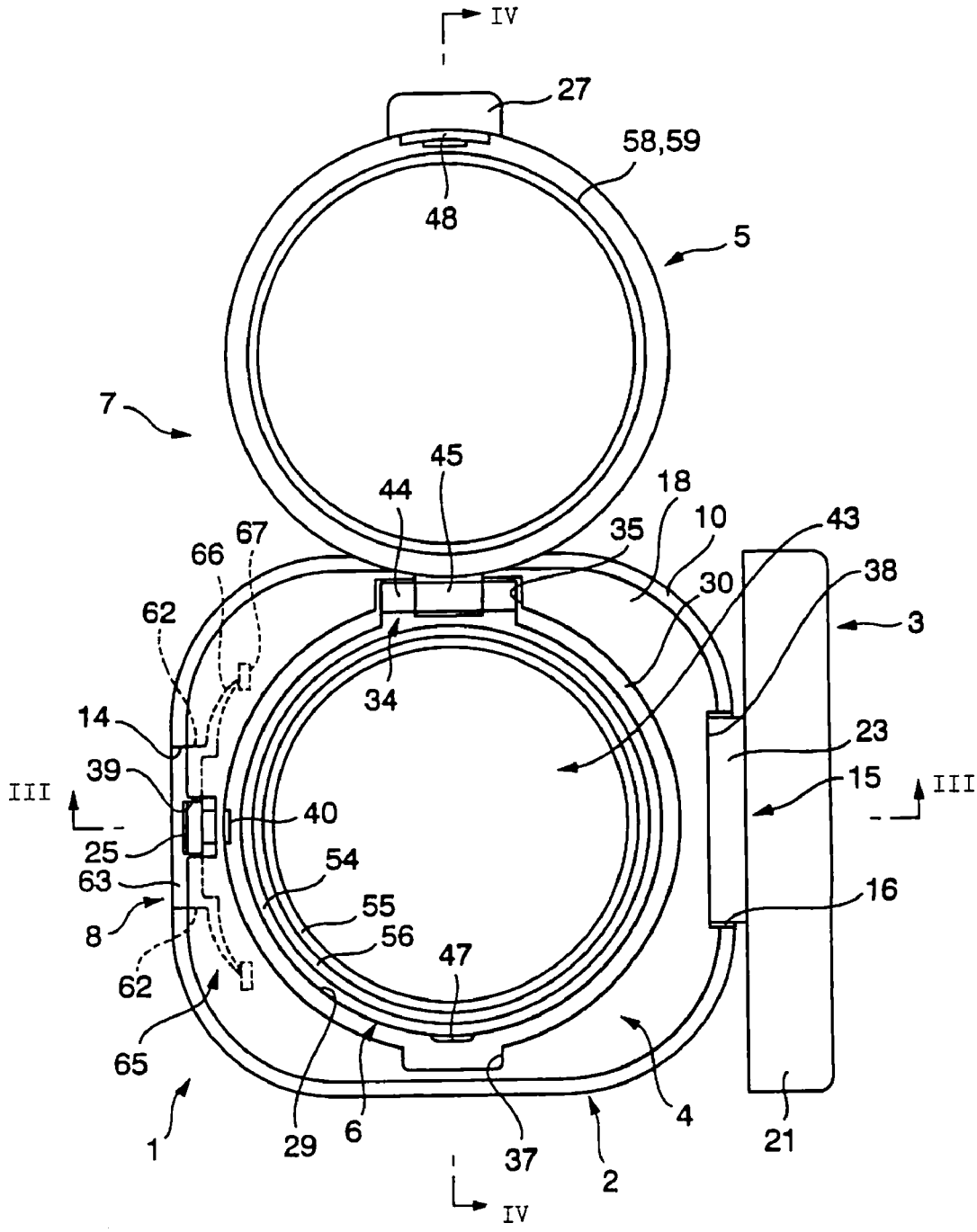
FIG. 2 is a plan view illustrating a state where the lid body and the lid portion of the airtight compact container of FIG. 1 are open.
Figure 3:
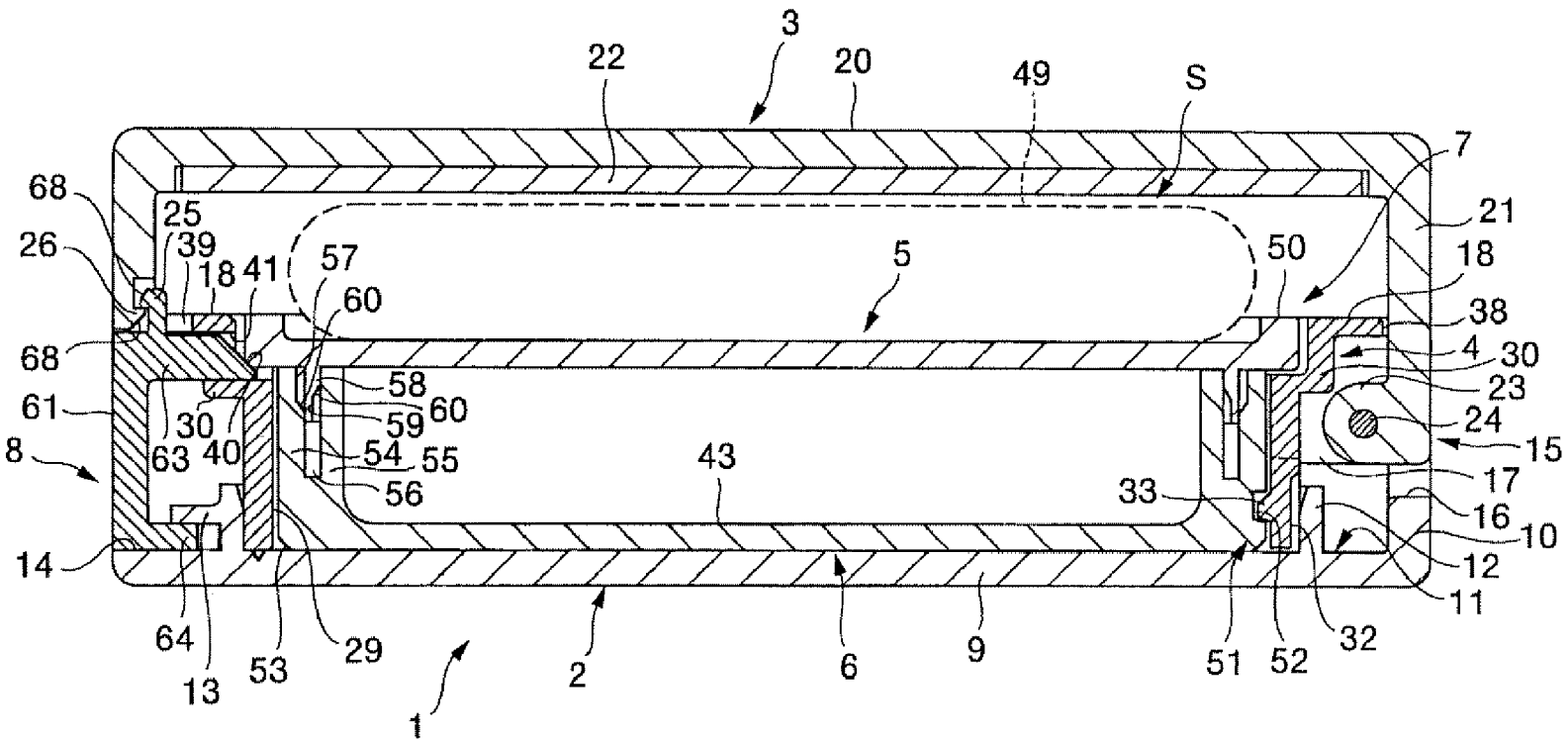
FIG. 3 is a sectional view on line III-III of FIG. 2, as viewed in the arrow direction, of the airtight compact container having the lid body and the lid portion closed.
Figure 4:
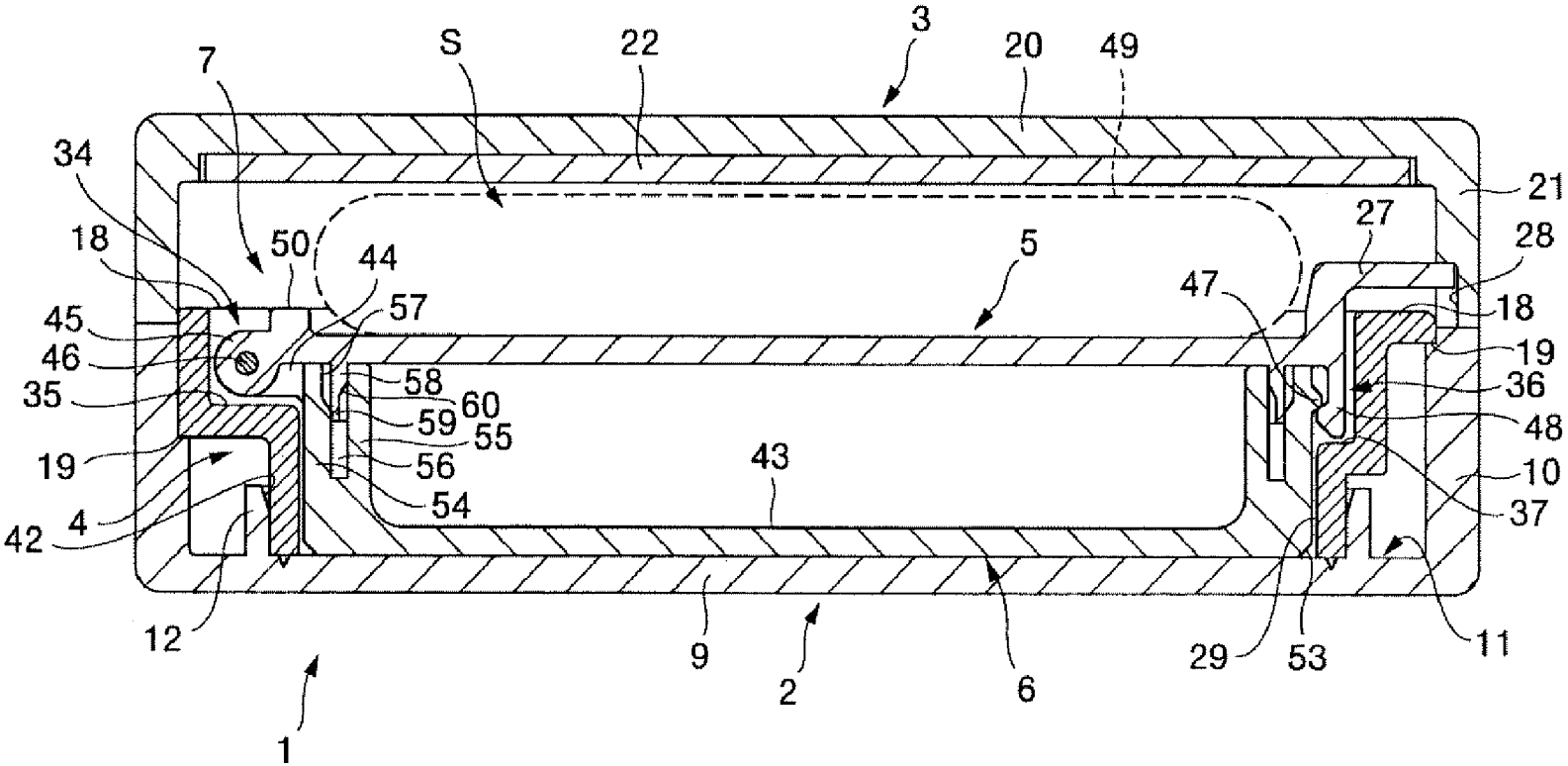
FIG. 4 is a sectional view on line IV-IV of FIG. 2, as viewed in the arrow direction, of the airtight compact container having the lid body and the lid portion closed.

A preferred embodiment of an airtight compact container according to the present invention will be described in detail with reference to the accompanying drawings. An airtight compact container 1 of the embodiment mainly comprises, as shown in FIGS. 1 to 4, a container body 2, a lid body 3 to open/close the container body 2, an inner frame 4 provided in the container body 2, a refill container 7 having a lid portion 5 and a plate 6 that is housed detachably in the container body 2 via the inner frame 4, and a push piece 8 for opening the lid portion 5 of the refill container 7 and the lid body 3 of the container body 2.

The container body 2 is made oft synthetic resin and formed of a bottom 9 and a circumference side wall 10 extending upward from the edge thereof. A cavity 11 is formed by the inside defined by the bottom 9 and the circumference side wall 10. On the bottom 9 of the container body 2, a circular guide wall 12 that guides the inner frame 4 to be set is formed a given space apart inward from the circumference side wall 10. A slide guide 13 that slidably guides the push piece 8 is formed protruding radially outward from the guide wall 12. In the circumference side wall 10, a cut 14 is formed opposite the slide guide 13. Another cut 16 is formed in circumference side wall 10 opposite the cut 14 so that a joint 15 provided in between, and joining, the lid body 3 and the container body 2 is disposed therein. A pair of joint blocks 17 is formed protruding inward from the circumference side wall 10 on opposite sides of the cut 16. Furthermore, a recess 19 is formed along the inner surface of the circumference side wall 10 so as to fit together with an annular cover 18 forming part of the inner frame 4.

The lid body 3 is also made of synthetic resin, and formed of a top 20 whose outline coincides with that of the container body 2 and a circumference side wail 21 extending downward from the edge thereof. A space S is formed by the inside defined by the top 20 and the circumference side wall 21. In the state where the container body 2 is closed with the lid body 3, the lower edge of the circumference side wall 21 contacts the upper edge of the circumference side wall 10 of the container body 2. A mirror 22 is provided fitting on the back side of the top 20.

A joint piece 23 extending further downward from the circumference side wall 21 is formed corresponding in position to the cut 16 of the container body 2 so as to fit in between the pair of joint blocks 17. The joint piece 23 is shaped like an L in sectional view such that its end is located inside the container body 2 and further inside than the circumference side wall 10. Moreover, the joint 15 is formed by inserting a joint pin 24 into the joint piece 23 at its end, which is located inside the container body 2, so as to bridge between the pair of joint blocks 17, and thus the lid body 3 is rotatably coupled to the container body 2, so that the container body 2 can be opened and closed with the lid body 3. Since the joint pin 24 and the joint 15 as a whole are arranged inside the container body 2, the beautiful appearance of the airtight compact container 1 is secured.

A fastening hook 26 that detachably engages with a hook 25 forming part of the push piece 8 is formed corresponding in position to the cut 14 of the container body 2 on the inner surface of the circumference side wall 21 of the lid body 3. A press-down portion 28, which engages with a finger-hooking flange 27 formed on the lid portion 5 of the refill container 7 from above so as to press down and hold the flange 27 when the lid body 3 is closed, is formed by setting back into the circumference side wall 21 at its inner surface.

The inner frame 4 is made of synthetic resin, and formed of a circumference wail 29 whose outline is shaped in a circle, in plan view, along the inner circumference of the guide wall 12 of the container body 2, and the annular cover 18 formed around the circumference wall 29 along the circumferential direction. The circumference wall 29 and the annular cover 18 are integrally formed having a step 30 in between at a given height of the circumference wall 29. The inner frame 4 is fixed by ultrasonic bonding or the like at the lower edge of the circumference wall 29 to the bottom 9 of the container body 2 inside the guide wall 12. The annular cover 18 fits at its outer edge together with the fit-together recess 19 of the container body 2 such that its upper surface almost coincides at height with that of the circumference side wall 10 of the container body 2. Thus, the space between the circumference wall 29 and the circumference side wall 10 of the container body 2 is covered by the annular cover 18, so that the joint 15 and the cut 14 are concealed from above and that inside the container body 2, the bottom 9 is seen surrounded by the inner frame 4 which has the annular cover 18 extending the circumference wail 29, thus securing the beautiful appearance. The refill container 7 is housed inside the inner frame 4.

Elastic flexible pieces 32 are formed spaced a given distance apart in the circumferential direction in the circumference wall 29 of the inner frame 4, which pieces are each defined by a pair of left and right slits 31 in the lower end of the circumference wall 29, and an engaging tab 33 is formed on each of the elastic flexible pieces 32 inward from the inner frame 4. By setting downward part of the annular cover 18, a hinge receiving portion 35 for housing a hinge 34 provided on the refill container 7 is formed. Furthermore, by setting downward part of the annular cover 18, a recess 37 to receive a closing portion 36 provided on the refill container 7 is formed. Also, in the annular cover 18, a cut 38 to receive the joint 15 is formed corresponding in position to the cut 16.

In the annular cover 18, a guide recess 39 to guide the hook 25 of the push piece 8 when being moved is formed corresponding in position to the cut 14 of the container body 2. An opening 41 into which a pushing-up portion 40 formed in the push piece 8 is inserted is formed in the step 30, extending from the cut 14 Inside the circumference wall 29. Also, the step 30 is formed to provide a space where the lid portion 5 of the refill container 7 is placed such that the upper surface of the refill container 7 almost coincides at height with that of the annular cover 18 and that there is no space between the plate 6 of the refill container 7 and the circumference wall 29. A slope surface 42 is formed on the guide wall 12 to smooth the mounting of the inner frame 4.

The refill container 7 is made of synthetic resin, and shaped in a circle, in plan view of its outline, along the inner surface of the circumference wall 29 of the inner frame 4. The refill container 7 comprises the plate 6 having a cosmetic containing portion 43 that contains a cosmetic; the lid portion 5 to open/close the plate 6, which is rotatably coupled to the plate 6 via the hinge 34 that is corresponding in position to the hinge receiving portion 35 of the inner frame 4; and the closing portion 36 to openably fasten the lid portion 5 to the plate 6, which is formed corresponding in position to the recess 37 of the inner frame 4. The lid portion 5 of the refill container is formed larger in diameter than the plate 6. The hinge 34 comprises a pair of hinge blocks 44 formed protruding outward radially from the plate 6; a hinge piece 45 formed protruding outward radially from the lid portion 5 and fit in between the pair of hinge blocks 44; and a hinge pin 46 that is inserted through the pair of hinge blocks 44 and the hinge piece 45.

The closing portion 36 comprises a locking tab 47 formed protruding outward radially from the plate 6 and a locking piece 48 extending downward from the lid portion 5, which detachably engages with the locking tab 47. An annular raised portion 50 is formed along the outer edge of the lid portion 5 so as to hold a makeup tool 49 such as a puff mounted on the lid portion 5, which tool is to be housed in the space S. On the annular raised portion 50, the finger-hooking flange 27 is formed which extends over the annular cover 18 of the inner frame 4 toward under the circumference side wall 21 of the lid body 3 and is corresponding in position to the press-down portion 28 of the lid body 3 and which engages with the press-down portion 28 when the lid body 3 is closed. The finger-hooking flange 27 is used to hook a finger when opening the lid portion 5.

A fastening portion 51 that detachably fastens the refill container 7 to the inner frame 4 is provided between the plate 6 of the refill container 7 and the circumference wall 29 of the inner frame 4. The fastening portion 51 comprises the engaging tab 33 and an engaging recess 52 made in the plate 6 corresponding in position to the engaging tab 33. When pushing the refill container 7 into the inside of the inner frame 4, the elastic flexible piece 32 having the engaging tab 33 is deformed further outward than the inner frame 4, and when the engaging recess 52 is placed opposite the engaging tab 33, the elastic flexible piece 32 is elastically restored and the engaging tab 33 engages with the engaging recess 52, thereby holding the refill container 7 in the container body 2. The inner bottom surface of the plate 6 is formed by a slope surface 53 to smooth the insertion into the inner frame 4.

In the plate 6, the cosmetic containing portion 43 is formed inside a pair of annular walls 54, 55 facing each other, and the pair of annular walls 54, 55 defines an annular groove 56 in between around the outer edge of the cosmetic containing portion 43 along the circumferential direction of the plate 6. An annular recess 57 is formed above the annular groove 56 along the circumferential direction. In the example shown in the Figures, the annular recess 57 is formed by setting back the upper edge of the outer annular wall 54 outward radially.

On the lid portion 5, an annular, first flexible airtight seal portion 58 extending down toward the annular groove 56 is formed corresponding in position to the annular groove 56 and to be at a height corresponding to that of the annular recess 57. When the lid portion 5 is being closed, the first airtight seal portion 58 is inserted into the annular groove 56, at which time the seal portion 58 goes into the annular groove 56 with frictionally contacting the inner annular wall 55, and with being elastically deformed toward the annular recess 57 by the frictional contact, is pressed strongly against the inner annular wall 55, thus producing an airtight seal action.

In the lower end of the first airtight seal portion 58, an annular, second flexible airtight seal portion 59 is formed along the circumferential direction to be below the annular recess 57. The second airtight seal portion 59 is capable of being elastically deformed in the annular groove 56 and is thinner than the first airtight seal portion 58. When the lid portion 5 is being closed, the second airtight seal portion 59 goes into the annular groove 56 ahead of the first airtight seal portion 58 with frictionally contacting part of the outer annular wall 54 below the annular recess 57, and with being elastically deformed toward the inner annular wall 55 by the frictional contact, is pressed strongly against the outer annular wall 54, thus producing an airtight seal action.

That is, by elastic reverting action of each other, the first and second airtight seal portions 58, 59 are pressed strongly against the annular walls 55, 54 respectively in between the pair of annular walls 54, 55, thus securing an effect of airtight sealing at two points, upper and lower. In the annular recess 57 and on the first airtight seal portion 58, a slope surface 60 is formed to smooth the inserting of the second airtight seal portion 59 into the annular groove 56 and to smooth the inserting of itself into the annular groove 56, respectively.

The radial width at the annular recess between the annular walls 54, 55 of the refill container 7 is larger than that of the annular groove 56, and the lower part 59 of the extending downward piece is thinner radially than the upper part 58 thereof and smaller in radial width than the annular groove 56, and when the lid portion 5 is closed to the plate 6, the outward surface of the lower end of the extending downward piece is elastically pressed against the outer one 54 of the annular walls while the inward surface of the upper end of the extending downward piece is elastically pressed against the inner one 55 of the annular walls.

In the example shown in the Figures, the annular recess 57 is formed in the outer annular wall 54, and the first airtight seal portion 58 is pressed against the inner annular wall 55 and the second airtight seal portion 59 against the outer annular wall 54. However, conversely, the annular recess 57 may be formed in the inner annular wall 55, and the first airtight seal portion 58 may be pressed against the outer annular wall 54 and the second airtight seal portion 59 against the inner annular wall 55.

The push piece 8 is made of synthetic resin and formed of a pressing wall portion 61 in the front; a pair of side wall portions 62 protruding toward the inside of the container body 2 from both left and right ends of the pressing wall portion 61; an upper wall portion 63 protruding toward the inside of the container body 2 from the upper end of the pressing wall portion 61; and a lower wall portion 64 protruding toward the inside of the container body 2 from the lower end of the pressing wall portion 61, thus taking the form of a U-shaped box in side sectional view. The pressing wall portion 61 is placed in the cut 14 of the container body 2 so as to close the cut 14. The lower wall portion 64 is fastened onto the bottom 9 of the container body 2 by the slide guide 13 so as to be slidable toward the further inside of the cut 14, and the push piece 8 is operable to be pushed toward the further inside of the cut 14 by pushing the pressing wall portion 61 toward the inside of the cut 14 causing the lower wall portion 64 to slide.

Furthermore, a restoring means 65 that restores the pushed-in push piece 8 is provided in between the push piece 8 and the container body 2. The restoring means 65 comprises a pair of plate springs 66 formed extending outward from the pair of side wall portions 62 of the push piece 8 respectively; and stop walls 67 formed in the container body 2 against which the ends of the pair of plate springs 66 slidably press respectively, and restores the pushed-in push piece 8 by the plate springs 66 elastically reverting against the stop wails 67.

The hook 25, which detachably engages with the fastening hook 26 of the lid body 3 thereby retaining the lid body 3 and maintaining the container body 2 closed, is formed protruding upward from the upper wall portion 63 of the push piece 8. Slope surfaces 68 are formed respectively on the hook 25 and the fastening hook 26 to frictionally contact each other thereby guiding them to engage.

On the upper wall portion 63, the pushing-up portion 40 is formed to protrude through an opening 41 into the inside of the inner frame 4 and to engage from below with the lid portion 5 of the refill container 7 retained in the inner frame 4. In the example shown in the Figure, the pushing-up portion 40 is sloped at a downward angle with respect to the operation direction of pushing the push piece 8 and constituted as a downward slope to contact the lower edge of the lid portion 5. When pressing the pressing wall portion 61, the push piece 8 is moved in the cut 14 toward the further inside of the container body 2, and thereby the hook 25 is released from the fastening hook 26 of the lid body 3 and at the same time, the pushing-up portion 40 goes further into the inside of the inner frame 4 through the opening 41, pushing up the lid portion 5. As a result, the lid body 3 is put in an openable state and, since the locking piece 48 of the lid portion 5 is released from the locking tab 47 of the plate 6, the closing portion 36 of the refill container 7 is unlocked, so that the lid portion 5 is put in a slightly open state.

Next, the actions of the airtight compact container 1 according to the present embodiment will be described. First, the assembly of the airtight compact container 1 will be described. By fitting the joint piece 23 in between the joint blocks 17 and inserting the joint pin 24, the lid body 3 with a mirror 22 is rotatably coupled to the container body 2. Then, the push piece 8 is mounted in the cut 14 in such a way as to be fastened by the slide guide 13 and have the plate springs 66 frictionally contact the stop walls 67. Then, the inner frame 4 is mounted in the container body 2 with the pushing-up portion 40 being inserted into the opening 41, and attached with use of the guide wall 12. Thus, the joint 15 and the cut 14 are concealed by the annular cover 18. Meanwhile, as to the refill container 7, the lid portion 5 is rotatably coupled to the plate 6 by fitting the hinge piece 45 in between the hinge blocks 44 and inserting the hinge pin 46. Then, the refill container 7 has a cosmetic filled in the plate 6 and is closed openably with the closing portion 36.

In particular, the refill container 7 itself comprises a seal mechanism having high airtightness. As the lid portion 5 is being closed, the second airtight seal portion 59 moves into the annular groove 56, and at the same time that the second airtight seal portion 59 arrives below the annular recess 57, the first airtight seal portion 58 moves into the annular groove 56 and then arrives at the annular recess 57, at which time the first airtight seal portion 58 is deformed elastically toward the annular recess 57 with being pressed against the inner annular wall 55. At the same time, the second airtight seal portion 59 is deformed elastically in the annular groove 56 with being pressed against the outer annular wall 54. Thus, both the first and second airtight seal portions 58, 59 are firmly pressed by elastic deformation action of each other against the pair of annular walls 54, 55 respectively, thereby producing a highly airtight seal.

As such, by pushing it into the inside of the inner frame 4, the refill container 7 containing a cosmetic is detachably fastened to the inner frame 4 by the fastening portion 51 and thus retained in the container body 2. At this time, the hinge 34 of the refill container 7 is received in the hinge receiving portion 35 of the inner frame 4 and the closing portion 36 is received in the recess 37. When the refill container 7 is removed from the inner frame 4, in order to release the engagement in the fastening portion 51, the refill container 7 needs to be lifted up from the inner frame 4 with use of the hinge 34. Thereafter, as the lid body 3 is being closed, the press-down portion 28 presses the finger-hooking flange 27 down and holds it. Thus, the lid portion 5 is closed firmly by the press-down portion 28 as well as the closing portion 36. Also when the closing portion 36 is in a released state and the lid portion 5 is open, the lid portion 5 can be closed by the press-down portion 28 pressing down the finger-hooking flange 27. Therefore, failing to close the lid portion 5 can be prevented.

When the lid body 3 contacts the circumference side wall 10 of the container body 2, the fastening hook 26 and the hook 25 of the push piece 8 frictionally contact each other at their slope surfaces 68, and the fastening hook 26 pushes the hook 25 in slightly and comes under it, at which time the restoring means 65 restores the push piece 8 and the hook 25 engages with the fastening hook 26, thus holding the lid body 3 closed.

When opening the lid body 3 for a makeup operation, the push piece 8 is pushed into the container body 2 with a finger. When the push piece 8 is pushed, at the same time that the hook 25 is released from the fastening hook 26, the pushing-up portion 40 pushes up the lid portion 5. Thus, the lid body 3 becomes openable and simultaneously the closing portion 36 is released, thereby putting the lid portion 5 in a slightly open state. With pushing the push piece 8, the lid body 3 is opened. Thereafter, when moving the finger away from the push piece 8, the push piece 8 is restored to its original position by the restoring means 65. When the lid body 3 is opened, the closing portion 36 is already released. Hence, by picking up the makeup tool 49 such as a puff on the lid portion 5 and opening the lid portion 5, the inside cosmetic can be exposed. After the makeup operation finishes, the makeup tool 49 is put on the lid portion 5, the lid portion 5 is closed so as to secure airtight sealing, and then the lid body 3 is closed.

The lid portion 5 of the refill container 7 is larger in diameter than the plate 6, and when the push piece 8 is pushed in, the pushing-up portion 40 acts to push up the periphery of the lid portion 5 at the lower edge.

Figure 5:
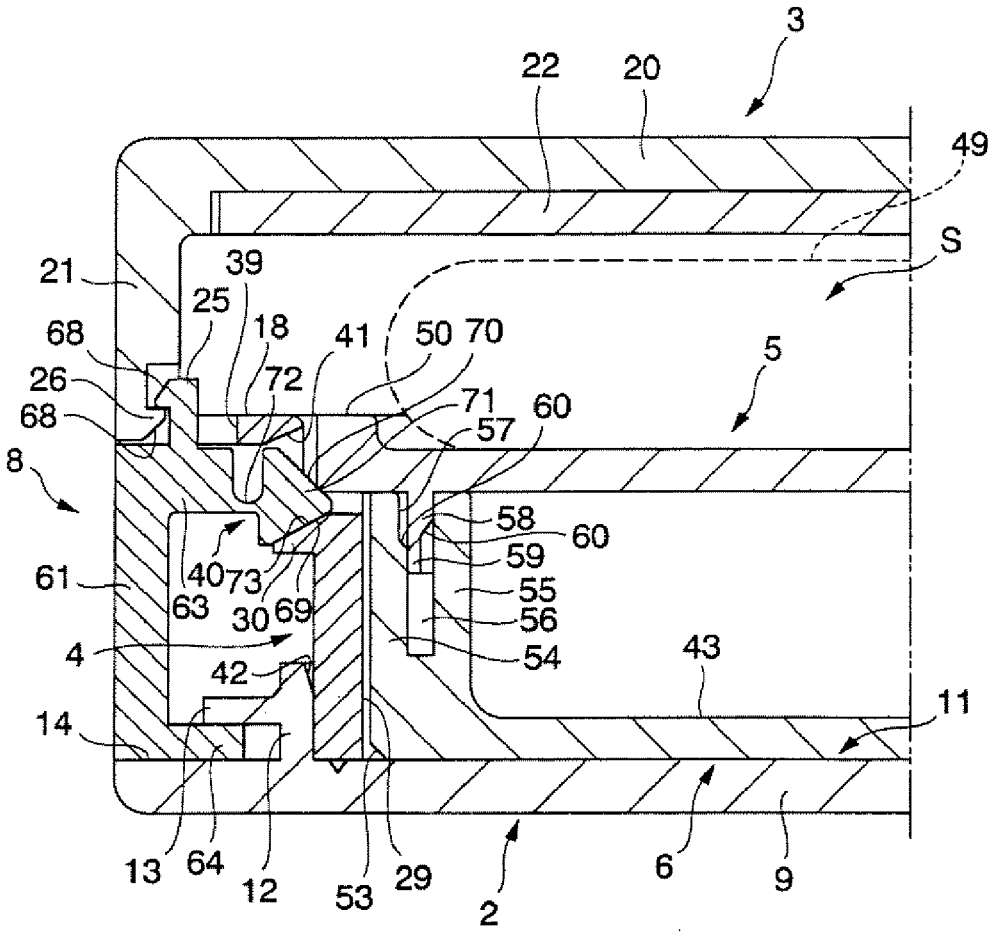
FIG. 5 is an enlarged sectional view illustrating a modified example of a push piece applicable to the airtight compact container according to the present invention.

FIG. 5 shows a modified example of the pushing-up portion 40 of the push piece 8. In this modified example, the pushing-up portion 40 is shaped in a triangle in side sectional view, and comprises a pushing-up block 71 that has a slope 69 at an upward angle with respect to the operation direction of pushing in the push piece 8 as its lower surface and a slope 70 at a downward angle with respect to the operation direction of pushing in the push piece 8 as its upper surface; and a flexible portion 72 that connects the pushing-up block 71 to the upper wall portion 63 in such a way as to be able to freely swing up and down. Moreover, on the opening 41, a guide slope 73 is formed at an upward angle with respect to the operation direction of pushing in the push piece 8 so as to be frictionally contacted by the upward slope 69.

When the push piece 8 is pushed in, the upward slope 69 slides along the guide slope 73, thereby swinging up the pushing-up block 71 via the flexible portion 72, and by the swinging-up and its slope, the downward slope 70 pushes up the lid portion 5. In this modified example, together with the pushing-up by the downward slope 70, the swing of the pushing-up block 71 produced by the guide slope 73 and the upward slope 69 with use of the flexible portion 72 secures a large amount in pushing up even with a short push-in operation stroke. Hence, the pushing-up of the lid portion 5 can be completed appropriately and instantaneously.

The airtight compact container 1 according to the present embodiment as described above, comprises the container body 2 having the cavity 11 formed therein; the lid body 3 that is rotatably coupled to the container body 2 via the joint 15 and opens/closes the container body 2; the cut 14 formed in the container body 2; the synthetic resin-made refill container 7 whose outline is shaped in a circle, in plan view, and has the plate 6 that contains a cosmetic, the lid portion 5 rotatably coupled to the plate 6 via the hinge 34 to open/close the plate 6 and the closing portion 36 to openably fasten the lid portion 5 to the plate 6; the inner frame 4 which has the circumference wall 29 whose outline is shaped in a circle, in plan view, and the annular cover 18 formed around the circumference wall 29 along the circumferential direction, to conceal the Joint 15 and the cut 14 from above and to cover the space between the circumference wall 29 and the container body 2 and which is fixed into the cavity 11 to house the refill container 7 therein; the fastening portion 51 provided between the plate 6 of the refill container 7 and the circumference wall 29 of the inner frame 4 that detachably fastens the refill container 7 to the inner frame 4; the finger-hooking flange 27 formed protruding from the lid portion 5 toward under the edge of the lid body 3; the hinge receiving portion 35 formed in the inner frame 4 that receives the hinge 34; the recess 37 formed in the inner frame 4 that receives the closing portion 36; the press-down portion 28 formed in the Lid body 3 that engages with the finger-hooking flange 27 from above to press it down and hold; the annular groove 56 defined and formed by the pair of annular walls 54, 55 facing each other in the plate 6; the annular recess 57 formed above the annular groove 56 along the circumferential direction; the annular, first airtight seal portion 58 formed extending down toward the annular groove 56 from the lid portion 5, which is elastically deformed toward the annular recess 57 with being pressed against the one annular wall 55, thereby sealing air-tightly; the annular, second airtight seal portion 59 formed in the lower end of the first airtight seal portion 58 along the circumferential direction, which is elastically deformed in the annular groove 56 with being pressed against the other annular wall 54, thereby sealing air-tightly; the push piece 8 supported in the container body 2 and provided in the cut 14 so as to be operable to be pushed, which has the hook 25 that detachably engages with the lid body 3 thereby maintaining the container body 2 closed and the pushing-up portion 40 that engages with the lid portion 5 from below through the opening 41 formed in the inner frame 4 so as to push up the lid portion 5 to open the refill container 7 and which pushes up the lid portion 5 by the pushing-up portion 40 at the same time that a pushing operation releases the hook 25 from the lid body 3; and the restoring means 65 provided in between the push piece 8 and the container body 2, which restores the pushed-in push piece 8.

INDUSTRIAL APPLICABILITY

As such, the inner frame 4 separate from the container body 2 and the refill container 7 is used, and the fastening portion 51, the hinge receiving portion 35 and the recess 37 are formed in the inner frame 4, thus simplifying the structures of the container body 2 and of the refill container 7. Furthermore, the inner frame 4 conceals the cut 14, the joint 15, the space and the like, providing the beautiful appearance, and the hinge receiving portion 35, the recess 37, and the fastening portion 51 improve the housing and handling capabilities of the refill container 7. Moreover, the lid body 3 and the lid portion 5 can be opened simultaneously with the push piece 6, and failing to close the lid portion 5 can be prevented by the finger-hooking flange 27 and the press-down portion 28, thus improving the open/close operability of the refill container 7 and the container body 2. Yet further, by configuring the pushing-up portion 40 to engage with the lid portion 5 through the opening 41 of the inner frame 4, diversity in the structure of the push piece 8 can be secured, and the airtight sealing by the interaction between the first and second airtight seal portions 58, 59 improves the sealing capability, thus achieving comprehensive improvement in the refill container housing-type airtight compact container 1.

What is claimed is:

1. An airtight compact container comprising:

a container body having a cavity formed on its top side and a cut in its circumference wall;

a lid body coupled to the container body via a joint so as to be able to open/close;

an annular inner frame attached in the cavity of the container body;

a refill container that is detachably attached inside the inner frame; and a push piece attached in the cut of the container body so as to be operable to be pushed in, wherein the inner frame has a circumference wall that, when attached, is located away inwards from the inside wall of the container body and an annular cover extending from the top of the circumference wall to the inside wall of the container body, wherein the refill container has a plate to contain a cosmetic; a lid portion rotatably coupled to the plate via a hinge to open and close the plate; a closing portion to openably fasten the lid portion to the plate; and a finger-hooking flange extending laterally outwards from the top of the closing portion, wherein the plate of the refill container is provided with an annular groove defined and formed by a pair of annular walls facing each other, and an annular recess is formed above the annular groove along its circumferential direction such that a corresponding space width differs from that of the annular groove; the lid portion has formed on its circumference underface a flexible, downward piece to be inserted into the annular groove when the lid portion is closed to the plate, and the downward piece has a first airtight sealing portion that elastically contacts and presses against one of the annular walls, thereby air-tightly sealing the lid portion to the plate and a second airtight sealing portion that elastically contacts and presses against the other of the annular walls, thereby air-tightly sealing the lid portion to the plate, wherein the circumference wall of the inner frame has on its inside an engaging means that detachably engages with the outside wall of the plate of the refill container, and the annular cover of the inner frame has recesses that receive respectively the hinge and the closing portion of the refill container; the outer end of the finger-hooking flange of the refill container is formed so as to engage with a press-down portion formed in the inside of a circumference wall of the lid body when the lid body is closed to the container body, thereby being pressed down, and wherein the push piece has a push wall to be pushed in; a top wall extending from the top of the push wall through between the circumference wall and annular cover of the inner frame inwards of the container body; a hook that detachably engages with the lid body thereby maintaining the container body closed; a pushing-up portion formed at the inward end of the top wall so as to contact the lower edge of the lid portion of the refill container, which portion exerts an upward divided force on the lower edge of the lid portion when the push wall and thus the top wall are pushed in; and a restoring means that elastically restores the push piece pushed in.

2. The airtight compact container according to claim it wherein a radial width at the annular recess between the annular walls of the refill container is larger than that of the annular groove, and the lower part of the extending downward piece is thinner radially than the upper part thereof and smaller in radial width than the annular groove, and when the lid portion is closed to the plate, the outward surface of the lower end of the extending downward piece is elastically pressed against the outer one of the annular walls while the inward surface of the upper end of the extending downward piece is elastically pressed against the inner one of the annular walls.

3. The airtight compact container according to claim 1 or 2, wherein the lid portion of the refrill container is formed larger in diameter than the plate, and when the push piece is pushed in, the pushing-up portion acts to push up the periphery of the lid portion at the lower edge.

4. The airtight compact container according to claim 1 or 2, wherein the hook of the push piece is formed protruding upwards from the top wall.

5. The airtight compact container according to claim or 2, wherein the pushing-up portion of the push piece has formed thereon a downward slope that slopes down in a pushing-in direction.

6. The airtight compact container according to claim 1 or 2, wherein the pushing-up portion of the push piece is formed substantially in a triangle shape in side sectional view, where its lower surface is an upward slope that slopes up in a pushing-in direction, while its upper surface is a downward slope that slopes down in the pushing-in direction, and part of the top wall connected with the pushing-up portion is formed as a flexible portion that enables the pushing-up portion to swing up and down; the upward slope contacts the lid portion of the refill container, and the downward slope slides along a guide slope provided at the back of the cut of the container body when being pushed in.

* * * * *